United States Patent [19]

Rapaelian

[11] 3,996,978

[45] Dec. 14, 1976

[54] FUEL NOZZLE ADAPTOR

[76] Inventor: Michael G. Rapaelian, 3831 Wisteria St., Seal Beach, Calif. 90740

[22] Filed: Jan. 7, 1976

[21] Appl. No.: 647,057

[52] U.S. Cl. ..... 141/285; 141/392

[51] Int. Cl.[2] ..... B65B 3/18

[58] Field of Search ..... 141/59, 198–229, 141/285, 52, 392

[56] References Cited

UNITED STATES PATENTS 3,451,445 6/1969 Sippola ..... 141/392

*Primary Examiner*—Houston S. Bell, Jr.
*Attorney, Agent, or Firm*—I. Michael Bak-Boychuk

[57] ABSTRACT

A fuel nozzle adaptor conformed for attachment to the end of a gasoline dispensing nozzle and comprising a convolved tubular body adapted to receive the end of the nozzle at one end thereof. Formed around the periphery of the nozzle receiving end of the adaptor is a circular groove having one radial port communicating with the interior thereof. Inserted in the port is a hollow pin having a flat exterior surface. A circular spring clip is placed within the groove urging the pin into the interior of the radial bore. The pin is therefore available for locking into the overflow sensing port of the nozzle with the interface between the exterior end of the pin and the circular spring clip providing a gas communication path to the interior.

5 Claims, 5 Drawing Figures

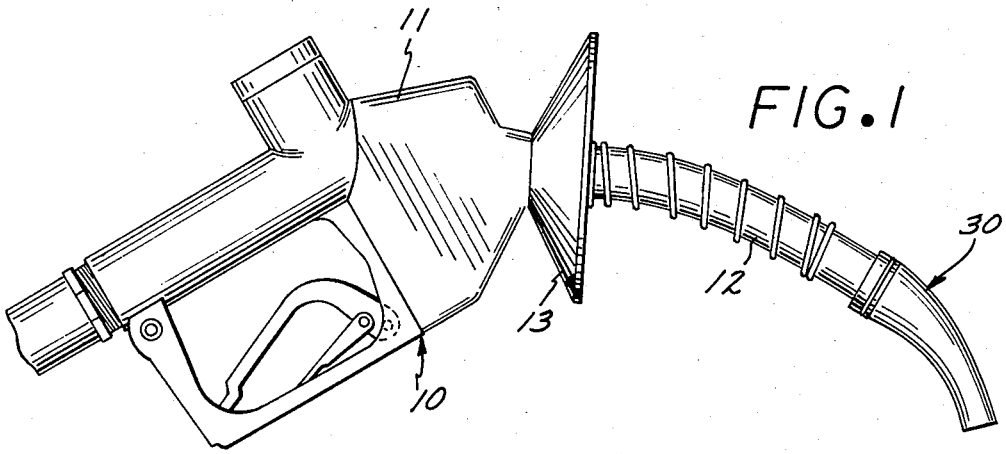
FIG. 1
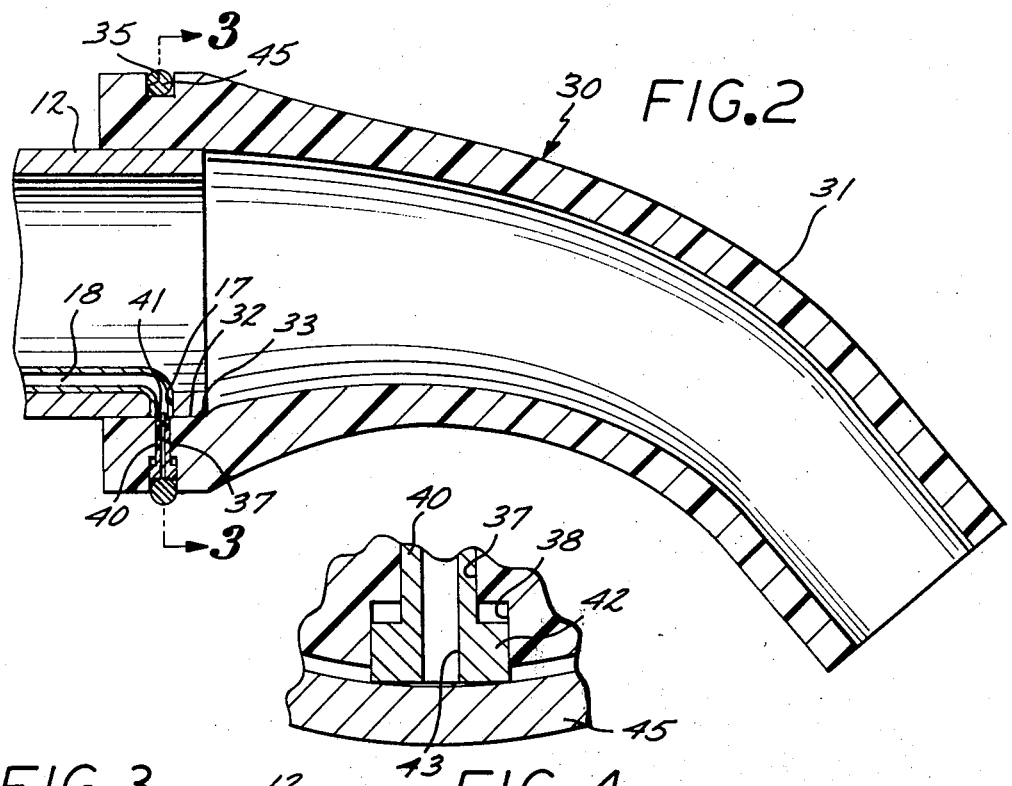
FIG. 2
FIG. 3
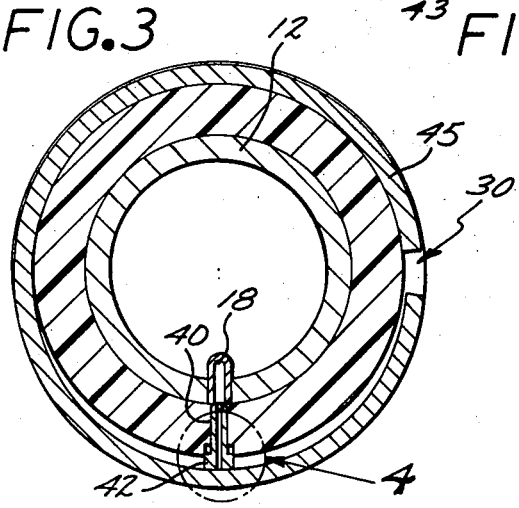
FIG. 4
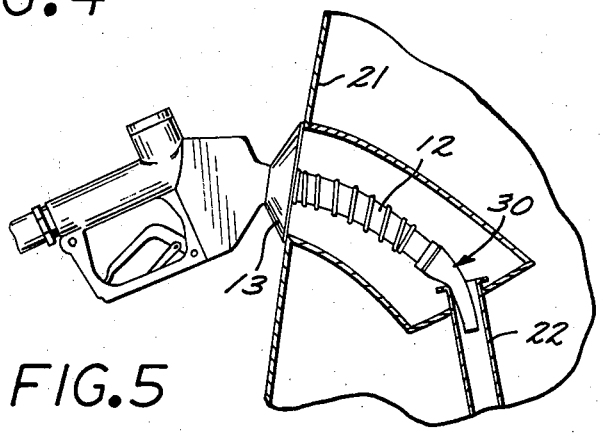
FIG. 5

FUEL NOZZLE ADAPTOR

BACKGROUND OF THE INVENTION

1. Field of the Invention

The present invention relates to gasoline dispensing systems, and more particularly to a nozzle extension for adapting a conventional gas dispensing nozzle to difficult receiving configurations in an automobile.

2. Description of the Prior Art

With the advent of vapor recovery systems now being increasingly required by statute, most gasoline station pumping facilities include nozzles provided with sealing boots through which the vapors emitted during filling are collected. Generally, such sealing boots are arranged to abut the surrounding structure of an automobile around the filling spout and in this manner contain the vapors emitted during filling. Since various automobile forms are still in use, some of which having been made before the advent of vapor recovery, various structural combinations of body to fill pipe geometry prevail rendering a single configuration fill nozzle inadequate for all of the uses contemplated. For this reason various combinations of adaptors have been devised in the past in order to extend a conventional nozzle to the varying fill pipe configurations. Most such prior art adaptors were quite complicated in their configuration since both a positive engagement with the end of the nozzle is required and a means to convey an overflow indication is also necessary. The complexity of such prior art adaptors necessarily increase their cost and therefore impose a large capital lay-out to the station owner or operator. It is because of that cost increment that many states have yet to pass the appropriate statutory provision directed at control of such vapor emissions.

SUMMARY OF THE INVENTION

Accordingly, it is the general purpose and object of the present invention to provide a fuel valve adaptor which, in a single structure, both provides a locking interface and an overflow detection passage.

Yet further objects of the invention are to provide a nozzle adaptor which is convenient in use and which can be conveniently installed and removed as the need arises.

Yet other objects of the invention are to provide a nozzle adaptor which is easy to produce, simple to maintain and requires few parts.

Briefly these and other objects are accomplished within the present invention by providing a nozzle adaptor generally formed in the manner of a tube having one end thereof conformed to a receiving dimension with the exterior of the nozzle end. Formed on the exterior of the adaptor, over the end conformed for telescopic receipt of the nozzle, is a peripheral groove communicating through a radially directed port with the interior cavity of the adaptor. Inserted in the radial port, in sliding receipt therein, is a hollow pin having one end thereof enlarged to limit the passage through the radial bore. The hollow pin is arranged with the enlarged end cap in the groove and the pin segment extending through the bore to project on the interior of the adaptor. To facilitate connection and removal, the interior end of the hollow pin is rounded and the pin itself is retained in the bore by a circular spring clip disposed in the peripheral grooves. In this arrangement, the hollow pin is disposed to engage the overflow detection port in the nozzle combining the retaining function and the gas communicating function in one single element. To render the assembly of the above described adaptor more convenient, there is formed on the interior thereof a reduced diameter shoulder separated from the receiving end by a dimension corresponding to the longitudinal dimension of the overflow detection port relative the end of the nozzle. With this arrangement of parts, the adaptor is simply pressed onto the end of the nozzle until contact is made between the shoulder and the end thereof. Once this contact is made the adaptor is then rotated until the pin aligns with the overflow detection port.

To ensure a communication path between the fill spout and the overflow detection port the exterior enlarged cap surface is cut on a flap and the circular spring clip comprises a wire element substantially smaller in diameter than the width of the peripheral groove. By this geometric arrangement only edge contact is made between the pin exterior and the circular spring thus leaving the center of the pin exposed to the overflow gases to be communicated through the hollow interior thereof to the overflow detection port.

BRIEF DESCRIPTION OF THE DRAWING

FIG. 1 is a side view of a conventional fuel fill nozzle inserted into an adaptor constructed according to the present invention;

FIG. 2 is a side view in section of the adaptor illustrated in FIG. 1;

FIG. 3 is a sectional end view taken along line 3—3 of FIG. 2;

FIG. 4 is an enlarged detail view of the end geometry of a pin useful with the present invention; and FIG. 5 is a side view illustrating the structure shown in FIG. 1 in use during filling of an automobile.

DESCRIPTION OF THE SPECIFIC EMBODIMENT

As shown in FIGS. 1 and 2, a fuel nozzle generally designated by the numeral 10 comprises a handle 11 attached to a tubular nozzle 12. In the recent past, such pump nozzles were modified to include a flexible boot 13 which contained the gas vapors emitted during filling and from which such gas vapors were routed back to some central collection area. Boot 13 is typically conformed to overlie the fill opening in the chassis of an automobile, making a seal therewith. Because of the many variations in automobile structure and particularly due to the continued use of automobiles produced prior to the advent of vapor recovery, the geometry of automobile chassis vary extensively and for that reason it has been necessary to provide a great degree of flexibility to the boot 13.

More specifically, as shown in FIG. 5, one chassis configuration is shown wherein the exterior body shell of the automobile 21 is separated by a substantial distance from the inlet of a fill pipe 22. While such chassis configuration was possible before the use of vapor recovery, the presence of the boot 13 on the nozzle assemblies now in use, has reduced the reach of the nozzle 12 to a point where proper insertion of the nozzle into the fill pipe is no longer possible. Thus, the gasoline station operator has been faced with the problem of either providing a variety of nozzle assemblies or has had to include in his assembly of tools an array of adaptors extending the reach of the nozzle.

An adaptor particularly convenient in use is shown and described herein. Referring back to FIGS. 1, 2 and 3, such an adaptor, generally designated by the numeral 30, comprises a convolved tubular housing 31 having an attachment end provided with a cavity 32 conformed for telescopic receipt of the end of the nozzle 12 and terminating in a free end conformed for insertion into the spill spout 22.

One additional feature generally present in the prior art nozzle assemblies is the overflow detection feature specifically illustrated in detail in FIG. 2. To provide overflow detection there is included in the free end of the nozzle 12, a radially directed port 17 which receives one end of an overflow detection conduit 18 attached at the other end to an overflow shut-off system (not shown). Typically all nozzles made by the same manufacturer would have a consistent geometric arrangement of port 17 relative the end of nozzle 12. This consistency is used to best advantage by the inventive adaptor disclosed herein according to details now to be described.

As shown in FIGS. 2, 3 and 4, the cavity 32 terminates on the interior end in a shoulder 33 which limits the inward progression of nozzle 12. An exterior groove 35 formed in a peripheral arrangement around the receiving end of nozzle 30 is aligned to substantially coincide with the longitudinal displacement of port 17. Thus the bottoming out of the end of nozzle 12 against the shoulder 33 will concurrently align port 17 in a radial plane which passes through the groove 35. Yet another radial bore 37 is formed to communicate between the peripheral groove 35 and the interior of cavity 32. Bore 37, by virtue of the dimensional arrangement of shoulder 33 and groove 35, is therefore aligned, again, in the same radial plane containing the overflow detection port 17. At the exterior end, bore 37 exits into an enlarged circular opening 38, which is dimensionally conformed to the width of groove 35. Received in the opening 38 and bore 37 is a hollow pin 40 having a rounded end 41 projecting into the interior of cavity 32 and an enlarged cap 32 slidably received within opening 38. The longitudinal dimensions of pin 40 are such that a part of the pin, and particularly the rounded end 41, extends into the interior of the adaptor 30 when the cap 38 bottoms out in its receiving stroke. By virtue of this dimensional arrangement, the rounded end of pin 40 will be in position for receipt within port 17 and only rotary or angular searching is necessary for proper alignment.

To provide for an inwardly directed restraint to the motion of pin 40 there is included within the peripheral groove 35 a circular spring clip 45 arranged to overlie the exterior surface of cap 42. Such end surface of cap 42 is cut along a plane and only edge contact is made with the clip 45. This arrangement assures gas passage around the spring clip 45 into the interior opening 43 of the pin.

By virtue of the arrangement disclosed above, pin 40 provides a dual function; one to retain the adaptor on the end of nozzle 12, and the other being to convey the gas pressures within the nozzle cavity into the interior of conduit 18. In this manner both a locking mechanism is provided and overflow detection is maintained by capitalizing on the inherent dimensional features of gasoline nozzles as practiced in the art.

Obviously many modifications and variations to the above disclosure can be made without departing from the spirit of the invention. It is therefore intended that the scope of the invention be determined solely dependent on the claims thereto.

I claim:

1. In a fuel nozzle assembly comprising a handle for manual control over fuel flow and a nozzle for insertion into the fill pipe of an automobile, said nozzle including an overflow detection port proximate the free end thereof, the improvement comprising:

a tubular adaptor including an interior cavity on one end thereof adapted to receive the free end of said nozzle;

a peripheral groove formed on the exterior of said adaptor in radial alignment with said overflow detection port when said nozzle is received in said cavity;

a radial bore formed in said adaptor communicating between the bottom surface of said groove and said interior cavity;

a hollow pin conformed for telescopic insertion of said radial bore, said pin including an enlarged exterior end cap to limit the inward progression thereof and a rounded interior end separated from said end cap by a dimension greater than the length of said radial bore; and a circular spring clip conformed for receipt in said peripheral groove for abutting said end cap and urging said hollow pin into said radial bore.

2. Apparatus according to claim 1 wherein:

the exterior end surface of said end cap is machined on of flat to thereby provide edge contact with said spring clip.

3. Apparatus according to claim 2 wherein:

said interior cavity includes a reduced diameter shoulder on the interior end thereof for limiting the inward progression of said nozzle.

4. Apparatus according to claim 3 wherein:

said shoulder is longitudinally displaced from said radial bore by a dimension substantially equal to the longitudinal displacement of said port from the free end of said nozzle.

5. Apparatus according to claim 4 wherein:

said radial bore includes an enlarged concentric opening formed within the bottom surface of said peripheral groove, said opening being conformed to receive said end cap.

* * * * *